United States Patent [19]

Cohn et al.

[11] 4,371,854

[45] Feb. 1, 1983

[54] BROADBAND HIGH-POWER MICROWAVE WINDOW ASSEMBLY

[75] Inventors: Seymour B. Cohn, Los Angeles; Arthur Karp, Palo Alto; David S. Stone, Los Altos, all of Calif.

[73] Assignee: Varian Associates, Inc., Palo Alto, Calif.

[21] Appl. No.: 258,065

[22] Filed: Apr. 27, 1981

[51] Int. Cl.[3] ..... H01P 1/08

[52] U.S. Cl. ..... 333/252; 333/33; 333/251

[58] Field of Search ..... 333/22 F, 35, 252, 251

[56] References Cited

U.S. PATENT DOCUMENTS 3,860,891 1/1975 Hiramatsu ..... 333/252 X 4,286,240 8/1981 Shively et al. ..... 333/252

*Primary Examiner*—Paul L. Gensler

*Attorney, Agent, or Firm*—Stanley Z. Cole; Peter J. Sgarbossa

[57] ABSTRACT

A window assembly for a hollow waveguide of circular cross-section, with improved bandwidth and cooling capability for handling high microwave power transmissions over wide frequency ranges, is disclosed. A plate or disc of dielectric of refractive index $n_1$ extends sealingly across the waveguide and has two parallel faces which exhibit a pattern of corrugations. One of these faces is in contact with a dielectric fluid of refractive index $n_2$, and means are provided for cooling and circulating the fluid over said one face. Each of the corrugations extends into the fluid a distance proportional to the inverse of the geometric mean of the product of the refractive indices $n_1$, $n_2$. In a preferred embodiment, a second plate is included, separated from the first by a region in which said dielectric fluid is circulated, and in which at least both the faces in contact with the fluid are corrugated. The corrugations not only result in greatly improved matching over a broad band, but also greatly improved fluid flow and surface contact thereof over said one face, for enhanced cooling and thus power handling capability of the window assembly.

27 Claims, 6 Drawing Figures

BROADBAND HIGH-POWER MICROWAVE WINDOW ASSEMBLY

DESCRIPTION

1. Field of the Invention

This invention relates to high power broadband microwave transmission. More particularly, it relates to windows for enabling microwave power to be transmitted from or into a section of waveguide which also may be a part of a vacuum device, such as an electron tube or plasma chamber, and which may be under vacuum or pressure.

2. Prior Art

Windows for passing microwave power have generally been a disc or slab of dielectric material, such as glass or ceramic, sealed across the hollow interior cross-section of a waveguide. Some have been circular in shape, adapted to circular waveguides carrying circular-electric-mode microwave power, as is common for high-power and low-loss applications.

Basically, to transmit power effectively, the material of the dielectric plate first is chosen for its mechanical and thermal properties. Then the shape and dimensions are chosen so that there will be a minimum of net radio wave reflection with respect to interfaces with neighboring materials. Interfaces such as those between vacuum, air, water, fluorocarbon dielectric liquids, ceramics, etc., are typically bridged by such a window.

The prior art has included many attempts to improve the efficiency or effectiveness over a broad frequency band of the transmission of power through interfaces of dissimilar material or through windows. In a typical window having two opposed faces and the same dielectric on both sides, it has been common to choose dielectric materials and spaces between interfaces so that the electrical distance between the first interface and the last interface is equal to an integral number of half wave lengths.

Another expedient has been to make the electrically effective axial length of the window an integral number of odd quarter wave lengths, with the parameters of the window selected to provide impedance equal to the geometric mean of the impedances on opposite sides of the window. However, both the foregoing provide good transmissivity only over a relatively narrow bandwidth.

In certain microwave antenna applications, it has been attempted to provide holes changing with depth, over the area of the faces of the window, transversely to the face thereof, thereby to provide a stepwise-graded transition to improve matching. But this expedient has achieved acceptance only for antennae and windows of non-refractory materials such as plastics, rather than for applications such as high-power microwave tubes which require windows of refractory material.

Due to the lack of perfect transmission through interfaces and windows, and the increasing power densities thereacross provided by more advanced microwave generator devices, the further perennial problem of dissipation or transferral of heat has become more acute. Such dielectric heating, if not controlled, can cause window failure by raising the temperature of a central area more than that of supported peripheries until the window breaks from the resulting uneven stresses. Also, "ghost" or trapped modes may exist in the window itself which are non-propagating in the empty waveguide itself; the power in this mode may build up with time to also thermally stress the window.

Cooling expedients have included the directing of air or dielectric liquid coolant over the non-vacuum facing side of the window. Also, for highpower applications, closely spaced windows have been provided between which has been circulated a dielectric liquid cooling fluid; see application Ser. No. 99,768, filed Dec. 3, 1979, now U.S. Pat. No. 4,286,240 issued Aug. 25, 1981, co-assigned herewith. Despite the existence of the foregoing expedients, the need has remained for improvements in cooling and improved matching, as the increasing power levels of new or improved types of microwave tubes, such as gyrotrons, increase performance requirements dramatically.

SUMMARY OF INVENTION

Accordingly, an object of the present invention is to provide a window assembly with improved transmissivity of microwave power across dielectric interfaces.

A further object of the invention is to provide a window assembly with improved combined frequency bandwidth and power handling capabilities.

A related object is to provide a window assembly having an enhanced cooling capability.

Another object of the invention is to provide a window assembly with one or more faces having a novel patterning structure promoting the attainment of the foregoing objects.

Yet another object of the invention is to provide a window assembly with complementary patterning on the faces thereof to promote preferential matching of circular modes.

These objects are achieved by providing a window assembly including a plate of dielectric material of first refractive index $n_1$ extending across an interior section of the waveguide and sealed to the interior thereof, with the plate defining two opposed faces. The assembly further includes a fluid, which may be air, of second refractive index $n_2$, within the waveguide interior on one side of the dielectric plate and in contact with one of the faces thereof. This face includes a pattern of corrugations across the area thereof, each corrugation projecting an axial height h into the fluid. The height h is proportional to the inverse of the geometric mean of the refractive indices $n_1$ and $n_2$. The assembly finally also includes means for circulating the fluid over the corrugated face so as to cool the dielectric plate. In this manner, good transmissivity over a wide bandwidth is achieved, as well as improved heat transfer across the interface between the dielectric material of the plate, and the dielectric fluid, for enhanced cooling capability. Thus, greater microwave power handling capability is provided.

In a further feature of the invention, the corrugations are aligned in a first direction, and on the other face of the plate a complementary pattern of corrugations is provided, aligned in a second direction at an angle to the first direction. The angle may be chosen to enhance transmissivity of desired modes, for example, the circular-electric mode.

In another embodiment of the invention, a second plate is provided adjacent and parallel to the first plate and spaced therefrom to define an enclosed region of the waveguide therebetween, the dielectric fluid being contained in said region and circulated therein. The movement of fluid along and between aligned corrugations enhances surface to fluid contact, turbulent flow, and overall fluid flow movement over the face, for better heat transfer to the fluid and improved cooling capacity.

DETAILED DESCRIPTION OF PREFERRED EMBODIMENTS

Figure 1:
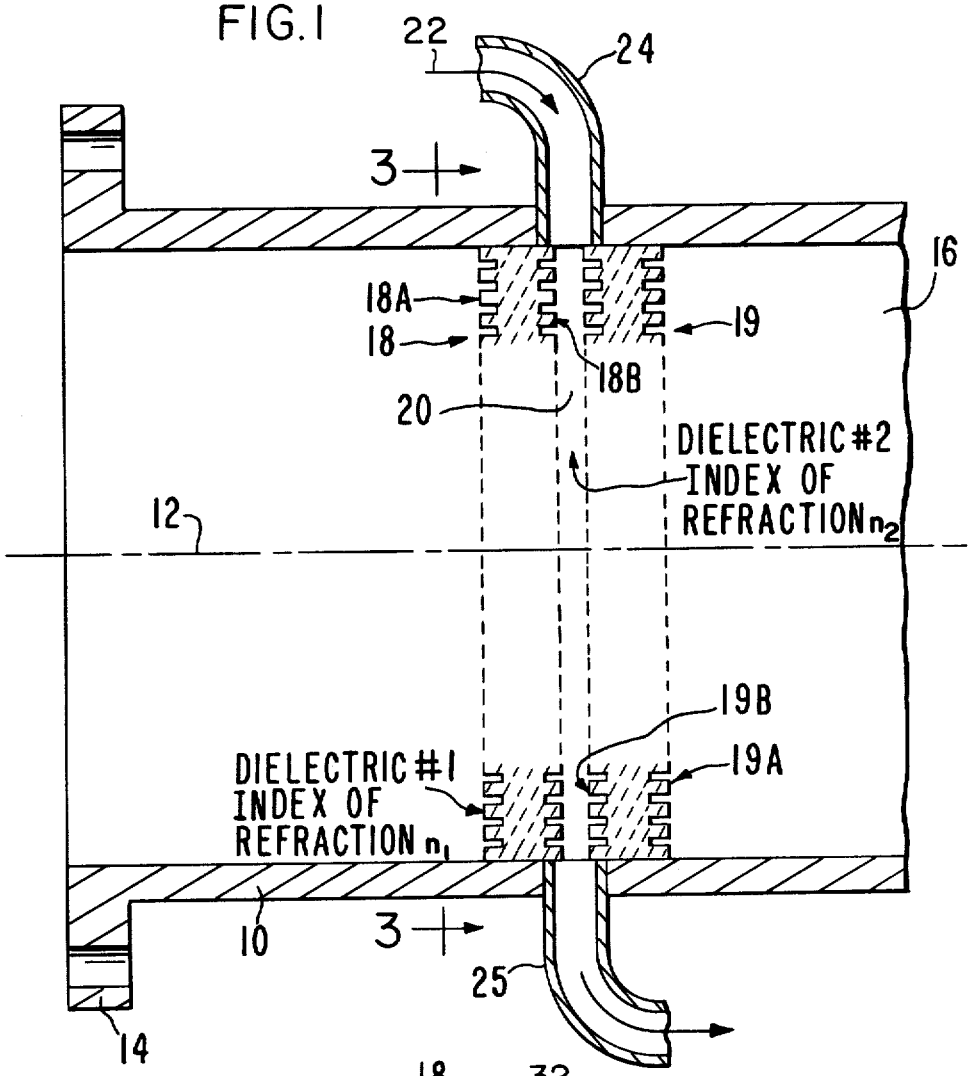
FIG. 1 is an axial cross-sectional view of a double disc embodiment of the window assembly of the invention, including the circulation of dielectric fluid coolant over the corrugated window faces.

FIG. 1 shows a double window embodiment example of the window assembly of the present invention. It is shown utilized within the context of a hollow circular waveguide 10, whose interior defines a right circular cylinder having an axis 12. The invention may be utilized with other types of waveguides and in other contexts, as will be shown, for example, in FIG. 4. However, FIG. 1 itself is illustrative of many possible applications; for example, waveguide flange 14 at one end of waveguide 10 may be connected to the input or output of a microwave generating tube or a plasma chamber. Similarly, the opposite end 16 of the waveguide can lead to the input or output of other microwave components; or the illustration may be considered representative of a portion of a microwave tube itself. Either the end adjacent flange 14, or end, or both, typically connect with a waveguide or microwave power-containing region which is under vacuum or pressure and thus must be isolated. Accordingly, the window plates or discs 18 and 19 are provided, the former of which isolates end 14, and the latter of which isolates end 16, by being positioned across the interior hollow cross-section of the waveguide, and sealed, as by brazing, to the interior wall thereof.

The two plates are spaced axially a short distance to form a narrow enclosed region 20 therebetween within the waveguide, for containing a cooling fluid 22 (which may, for example, be a low dielectric loss fluorocarbon liquid or gas, or even air). The plates respectively define inner faces 18B and 19B bordering region 20, and outer faces 18A and 19A, all of which are generally parallel. The plates themselves are fabricated, for example, of beryllia or alumina. The waveguide is of a metallic alloy.

Enclosed region 20 opens at least at the top thereof into inlet conduit 24; and also into outlet conduit 25 at least at the bottom thereof. (Apertures are provided in the wall of waveguide 10 for the conduits at least at two opposite ends of region 20. Here, for clarity of illustration, they are shown at the top and bottom of the figure, although they could be placed elsewhere, and be furnished in a plurality of such pairs). In this manner, fluid 22 may be introduced to fill region 20 between the plates, to completely cover inner faces 18A and 19A. Conduits 24 and 25 are connected to a conventional recirculating pump and cooling apparatus (not shown) to enable fluid 22 to circulate and provide cooling for plates 18 and 19, in order to remove heat generated due to dielectric losses therein.

Figure 2:
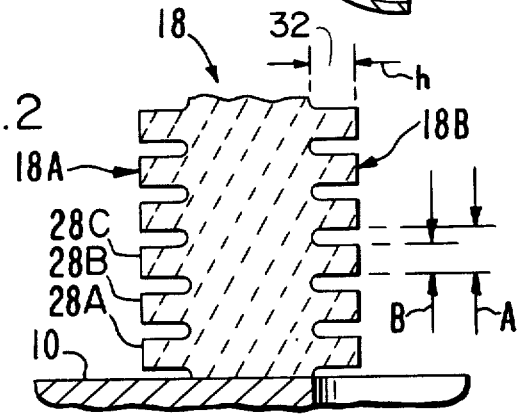
FIG. 2 is a schematicized cross-sectional detail view of FIG. 1, showing a typical window plate employed in the window assembly of the pesent invention, in particular the boundaries between material of different dielectric indices, and an example of the corrugations of the window faces in accordance with the invention.
Figure 3:
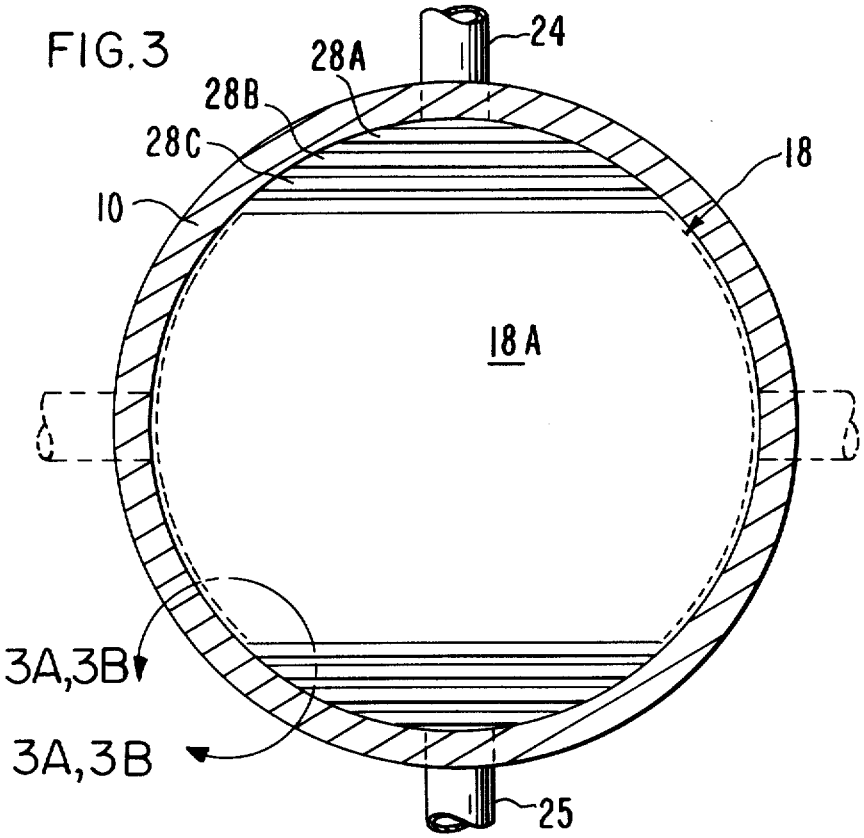
FIG. 3 is a schematicized plan view of a window plate as in FIGS. 1 and 2.
Figure 3A:
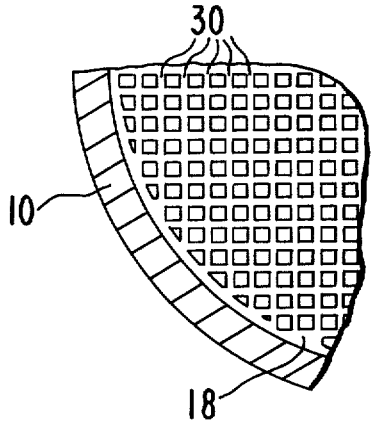
FIG. 3A is a fragmentary plan view similar to FIG. 3, but showing a variant "waffle" form of the corrugated window plate face of FIG. 3.
Figure 3B:
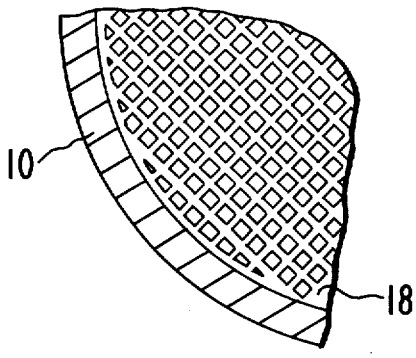
FIG. 3B is a fragmentary plane view similar to FIG. 3A, but showing an example of the opposite face of the window plate of FIG. 3A.

Such losses are minimized, and the cooling effects considerably enhanced, by the pattern of corrugations 28 defined in the plate faces, and which are shown in more detail in both the FIG. 2 cross-sectional detail view of plate 18 (or 19), and in the plan view of the faces of plate 18 (or 19) of FIG. 3. In the example of FIG. 2, corrugations 28A, 28B, 28C are, in axial cross-section in a plane perpendicular to the faces, of generally rectangular wave contour. This wave contour exhibits a regular period represented by the width "A", defines teeth or protruding corrugations 28A, 28B, 28C, etc. of solid dielectric of width "B" and protruding outwardly a height h. Teeth 28A, 28B, 28C comprise one cycle of the period of the wave contour, and may represent a greater or lesser percentage of the width of the total period, depending on matching requirements, as will be discussed below. The corrugations need not be confined to "square" wave contours in cross-section; they may also desirably be sinusoidal, sawtooth, or any of many other undulating patterns. As may also be seen from FIG. 3, the corrugations are preferably aligned side-by-side in a preferred first direction. Dielectric cooling fluid flow across the face is thus improved by being at least partially channeled along and within the corrugations, along said first direction. Note that "dead spaces" or regions in which cooling fluid is trapped and not subject to flow, are completely absent; rather, turbulent fluid flow at the fluid-solid dielectric interface is enhanced. Additionally, the surface area of the fluid-solid interface is also greatly enhanced as compared to a planar faced window, which is another factor in enhancing the heat transfer capability. Further, as shown in FIG. 3A, the corrugated faces are desirably also supplied with channels 30 running transversely to the aforesaid direction of the corrugation alignment. It is preferred that these channels be supplied in a number and spacing comparable to that of the corrugations, in this manner defining a waffle pattern of corrugations as illustrated in FIGS. 3A and 3B. In this manner still more fluid flow paths along and over the extent of the face are provided, and the surface area of the fluid plate interface is further increased, so that more fluid contacts the face.

Thus, heat dissipation and cooling capability are distinctly increased over non-corrugated cooled window designs. These benefits do not require a double window plate design as in FIG. 1; an embodiment with but a single window (as may for example envisaged with the aid of FIG. 2) gives similar benefits. In such a design, for example, a vacuum can be present on the side of the waveguide bordering face 18A; while on side 18B, air can be present and would be circulated over the corrugations as by employing a blower, for example. The effectiveness of such air-based cooling would be distinctly enhanced by the corrugations just as in the case of the liquid-based cooling described above.

The window assembly of the invention improves microwave power handling capability not only due to improved cooling capacity, but also because of superior matching across dielectric interfaces. As preferably seen from FIG. 2, the window plate itself comprises a solid of a first dielectric material, such as beryllia, with an index of refraction $n_1$. It interfaces, for example, at face 18B, with a second dielectric material, such as air or fluorocarbon fluid, or even with a vacuum, with an index of refraction $n_2$. The corrugations of height h define a boundry layer 32 of depth h between the homogeneous solid dielectric material of the window, and the homogeneous volume of the second dielectric material. For optimal matching, this boundary or intermediate layer 32 between the two homogeneous regions should have an effective refractive index of $\eta_{eff}$ of:

$$\eta_{eff} = \sqrt{n_1 n_2}$$

Furthermore, the depth h of this boundary layer should obey the following relationship:

$$\eta = \lambda_{eff}/4$$

or $$h = \frac{\lambda_o}{4\sqrt{n_1 n_2}}$$

where $\lambda_{eff}$ is the effective wave length within the solid dielectric, and $\lambda_o$ is the free space wave length. The quantities $n_1$ and $n_2$ are of course the aforementioned refractive indices.

With a pattern of corrugations of depth fulfilling the above criteria provided on the faces of the plate, a matching transformation across the boundary of the differing first and second dielectric materials is provided, to enable microwave power to be transmitted thereacross with minimal loss. Internal reflections will be of the same amplitude, but of opposite phase to result in complete destructive interference, and the vanishing of the net reflection coefficient.

The corrugations have previously been noted as not being confined to a particular profile. They are, however, preferably generally cyclical and periodic, at least in one direction along the face of the plate (in the illustrated example, in the vertical direction) with a regular period of width "A", as previously stated. The corrugations should appear to the microwaves incident thereon as a region of homogeneous material. Accordingly, the average periodicity must obey the relationship $$A \leqq \frac{\lambda_{eff}}{2}$$

The cycles or sides of the periodic profile of the corrugations are not, however, necessarily of equal width. As seen above, the dielectric teeth 28*a, b, c,* etc. within the face, and which comprise one side or cycle of the exemplary rectangular wave contour of FIG. 2, have a width B which is a large fraction of the total width A of the period. This fraction is a greater or lesser percentage of the total period, depending on the relative value of the two indices of refraction, or densities of the boundary materials. The value of B may be calculated for any corrugation contour or profile, and will also depend on the orientation of the microwave electric field relative to the dielectric interface. For the rectangular wave type of contour as depicted in FIGS. 2 and 1, the value of B may be approximated from the relationship:

$$\frac{B}{A} \approx \frac{n_2^2 - n_2 n_1}{n_2^2 - n_1^2}.$$

assuming that $n_2$ is greater than $n_1$, and the wave electric field is polarized perpendicular to the corrugations.

Corrugations of the plate faces in accordance with the foregoing requirements result in major advantages in bandwidth of transmissivity of the window assembly. In the case of a plate without corrugations, but rather having planar faces, the relative transmission frequency bandwidth is given by the approximate relationship $$\frac{\Delta f}{f} \approx \frac{\lambda_{eff}}{2L}$$

where $2L/\lambda_{eff}$ is the number of half wavelengths between the first and last interfaces, and L is the distance between the planar faces. It is clear from this relationship that the window band-width diminishes as the electrical thickness of the window is increased. For example, a double disk or plate window as in FIG. 1, but with planar faces, and an assumed electrical thickness L of 5.33 wavelengths, has an approximate bandwidth in accordance with the above relationship of $$\frac{\Delta f}{f} \approx \frac{\lambda_{eff}}{2(5.33)\lambda_{eff}}$$

or 9.4%. For such windows in exacting applications such as oscillators, for which the well-known transmissivity criteria of VSWR$\leqq$1.1 is a typical example, the bandwidth would by only 0.3%.

By contrast, the bandwidth over which a corrugated boundary or intermediary layer such as at 32 is effective is far greater. Again we employ the approximate relationship as above, but now the electrical thickness L is equal to h, or $\lambda_{eff}/4$, by definition. Thus for the corrugated boundary layer, $$\frac{\Delta f}{f} \approx \frac{\lambda_{eff}}{2\left(\frac{\lambda_{eff}}{4}\right)} = 2,$$

or roughly one octave. Similarly, for a comparable VSWR$\leqq$1.1, the bandwidth is 6.4%.

This bandwith improvement is preserved even where two or more such interfaces are utilized, and where the homogeneous region of the dielectric window is quite thick, as in the case of a microwave tube's output window. In particular, the double plate window assembly of FIG. 1, assuming again a comparable electrical window thickness of 5.33 wavelengths, also has a bandwidth of roughly one octave; and for VSWR$\leqq$1.1, also a bandwidth of 6.4%, a 20-fold improvement over the planar-faced case. Thus the transmission frequency bandwidth for a dielectric plate such as 18 or 19 may be increased from the value obtained if the faces were strictly planar to a value which is practically independent of total window thickness, but which rather depends only on the bandwidth of the corrugated interfaces; here, one octave.

As illustrated in FIG. 3 in particular, it will be seen that the corrugated patterns of the faces may take several forms. We have seen that the simple elongated and parallel corrugations of FIG. 3 are preferably broken by a plurality of channels 30, as shown in FIG. 3A, running transversely through the corrugations, to define the illustrated waffle pattern, providing many additional paths to improve fluid flow for cooling purposes. Both the simple corrugated pattern of FIG. 3 and the waffled variation of FIG. 3A can be seen to be oriented in a first direction generally perpendicular to the wave electric field. This orientation can be rotated with respect to the electric field in order to favor the transmission of various particular waveguide modes. The opposing faces of the same dielectric plate may also have patterns which are similar, except for being angularly rotated with respect to each other. See for example FIG. 3B, which represents an alternative orientation for one of the faces of the plate, while FIG. 3A would represent the orientation for the remaining face. It will be noticed that in this example, the orientations are at a 45° angle with respect to each other. Such an orientation favors the transmissivity of circular electric waveguide modes, and makes for a more uniform transmissivity of power across the plate. As a still further example, in the FIG. 1 embodiment, each of the four faces of the two dielectric plates 18 and 19 would be preferably rotated 22½° with respect to each succeeding face, for optimum transmissivity and uniformity of power distribution for circular modes. In this matter, still further features to improve the power handling capability of the window assembly are provided.

Figure 4:
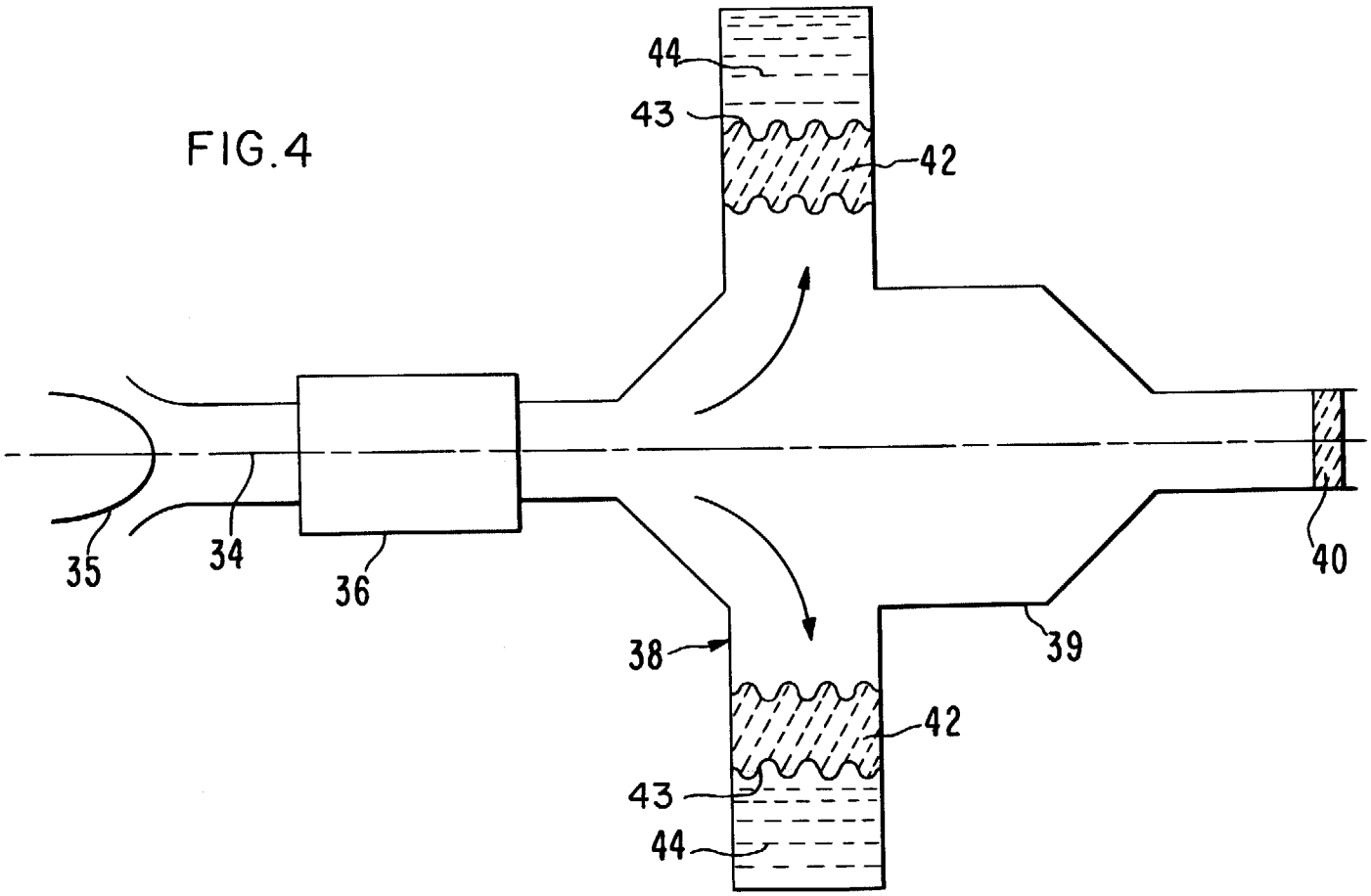
FIG. 4 is an axial cross-sectional view of a collector window embodiment of the window assembly of the invention, also showing a further alternate form of corrugations.

Still further variations are possible; for example, the imposition of further spatial variations upon the pattern of corrugations in order to match more favorably a desired waveguide mode; in particular, a spatial variation over a scale length which is large compared to the previously defined corrugation dimensions h, A and B. One example may be seen in FIG. 4, which also is illustrative of the range of applications of the present window assembly, as well as the usefulness of other forms of corrugation profiles beyond those depicted above. In FIG. 4, a schematicized microwave tube is shown, having a longitudinal axis 34, and which includes an electron gun or cathode 35, an interaction circuit 36 in which electron beam microwave interaction takes place using any of a variety of means, a collector/mode separator assembly 38, and a circular output waveguide 39 tapering to a terminating output waveguide window 40. In this case, it is desired to favor the production of circular electric modes, while trapping and absorbing undesired non-circular electric modes. It will be seen that these undesired non-circular modes, since they have an axial component, move away from the axis of the tube in the direction indicated by the arrows toward the corrugated dielectric collector window plate 42. Meanwhile, the circular-electric modes, which do not have an axial component, are unaffected, and continue out toward the output end of the tube.

The collector window 42 is actually an annulus with inner and outer corrugated faces centered and curving about the axis 34 of the tube. Both inner and outer faces are corrugated, with outer face 43 being immersed in a surrounding water jacket 44 which both helps to cool the collector window, and absorbs the unwanted electric modes which pass therethrough into the water. The presence of corrugations on face 43 aid in promoting cooling and the transferral of unwanted power away from the other portions of the tube to a considerable degree. The corrugations of both faces are also dimensioned in accordance with the principles disclosed above to provide a superior broadband match for these unwanted non-circular electric modes, thus minimizing heat buildup. Also promoting this broadband match is the fact that the annular configuration of the collector window design imposes a spatial variation which is large compared to the corrugation dimensions. Accordingly, the window assembly of the invention is not confined to use merely with classic circular waveguides, and may also be adapted to rectangular waveguides, a collector seal or window applications, coaxial waveguides in which the hollow cross section thereof is annular in shape, and many other waveguide types and microwave devices.

We claim:

1. A window assembly for a microwave waveguide including a hollow cross-section, comprising:

a plate of dielectric material of first refractive index $n_1$ extending across an interior hollow section of said waveguide and sealed to the interior of said section, said plate defining two opposed faces;

a fluid of second refractive index $n_2$ within a region of said waveguide interior on one side of said plate and in contact with one of said faces;

at least said one face having a pattern of corrugations across the area of said face, said corrugations each projecting an axial height h into said fluid, said height h being proportional to the geometric mean of the inverse of the product of the refractive indices $n_1$ and $n_2$;

and means for circulating said fluid over said one face so as to cool said plate.

2. The window assembly of claim 1 in which said corrugations are aligned.

3. The window assembly of claim 2 in which said corrugations are broken by a plurality of channels running transversely thereacross.

4. The window assembly of claim 3, in which said channels are supplied in a number and spacing comparable to that of said corrugations, whereby a waffle pattern is defined on said one face.

5. The window assembly of claim 1 in which said fluid is a dielectric liquid; in which said corrugations are generally aligned; and in which said means for circulating said fluid moves said liquid along and between said corrugations.

6. The window assembly of claim 1 in which said fluid is air.

7. The window assembly of claim 1 in which said pattern of corrugations defines, in a plane perpendicular to said one face, a rectangular wave having a regular period of width A, and a width B of one rectangle within said period.

8. The window assembly of claim 7 in which the ratio of B to A is given approximately by the relationship:

$$\frac{B}{A} \approx \frac{n_2^2 - n_2 n_1}{n_2^2 - n_1^2}$$

9. The window assembly of claim 1 in which the pattern of corrugation defines, in a plane perpendicular to said one face, a generally undulatory wave having a regular period of length A, with one side of said undulation extending over a width B.

10. The window assembly of claim 1 in which both faces of said plate includes said corrugations.

11. The window assembly of claim 9, in which the corrugations of said one face are aligned generally in a first direction, and the corrugations of said second face are aligned in a second direction at an angle to said first direction.

12. The window assembly of claim 1 in which a vacuum is maintained within the region of said waveguide adjacent to the other of the faces of said plate.

13. The window assembly of claim 1, which includes an additional plate of dielectric material generally parallel the original plate, and spaced therefrom, to form an enclosed region, with said one face facing into said region, said fluid being contained within said enclosed region.

14. The window assembly of claim 13 in which the face of said additional window facing said enclosed region includes said corrugations.

15. The window assembly of claim 13 in which both faces of both windows include said corrugations.

16. The window assembly of claim 1 in which said plate and waveguide interior cross-section are circular.

17. The window assembly of claim 1, in which the faces of said plate are curved.

18. The window assembly of claim 7, in which said curved faces are extended so as to form an annulus.

19. The window assembly of claim 18, in which both said curved faces are corrugated with the outermost face being in contact with said fluid.

20. The window assembly of claim 1, in which a further spatial variation is imposed upon said pattern of corrugations whereby to match more favorably a desired waveguide mode.

21. A window assembly for a waveguide of hollow circular cross-section, comprising:

a disc of dielectric material extending across an interior section of said waveguide and sealed to the interior of said waveguide said disc defining two opposed faces;

each said face having a similar pattern of corrugations across their respective areas, each said pattern of corrugations being aligned in a respective different direction, one of said directions being at an angle to the other, whereby to match more favorably a desired waveguide mode.

22. The window assembly of claim 21, which further includes means for directing over one of said faces a fluid for cooling said plate.

23. The window assembly of claim 21 in which one of said directions is generally at a 45° angle to the other, whereby to match more favorably a circular electric waveguide mode.

24. The window assembly of claim 23 in which a second similar disc of dielectric material is provided adjacent to and parallel the original disc, and in which the second disc is rotated by approximately 22½° with respect to the first.

25. A window assembly as in claim 24 which further includes a dielectric fluid filling the interior of the waveguide between said discs.

26. A window assembly as in claim 22 which further includes means for circulating and cooling said dielectric fluid.

27. A window assembly as in claim 21 in which said disc is circular.

* * * * *